United States Patent [19]

Schoeffler et al.

[11] 4,030,745

[45] June 21, 1977

[54] TOOL RETRIEVER FOR WELLS

[76] Inventors: William N. Schoeffler; Romona B. Schoeffler, both of Rte. 1, Box 389, Carencro, La.

[22] Filed: June 16, 1976

[21] Appl. No.: 696,854

[52] U.S. Cl. ..... 294/86.14; 294/86.28; 294/86.3

[51] Int. Cl.[2] ..... E21B 31/12

[58] Field of Search ..... 294/86.1, 86.11, 86.14, 294/86.15, 86.17–86.2, 86.22, 86.24–86.34, 99 R, 100, 115, 116

[56] References Cited

UNITED STATES PATENTS

| | | | |
|---|---|---|---|
| 784,055 | 3/1905 | Kroening | 294/86.14 |
| 1,526,412 | 2/1925 | Brown | 294/86.28 |
| 1,570,065 | 1/1926 | Jones | 294/86.29 |
| 1,680,596 | 8/1928 | Davis | 294/100 X |
| 1,742,767 | 1/1930 | Hughes | 294/86.29 X |
| 1,761,463 | 6/1930 | Beckett | 294/86.22 |
| 2,352,453 | 6/1944 | Salverda | 294/86.28 |
| 2,709,617 | 5/1955 | Lang | 294/86.3 X |

*Primary Examiner*—Johnny D. Cherry
*Attorney, Agent, or Firm*—Bacon & Thomas

[57] ABSTRACT

An outer tubular body member has a plurality of circumferentially spaced outwardly bowed spring fingers on its inner surface projecting downwardly to near the lower end of the body member and normally spaced apart. An inner tubular member is longitudinally movable in the body member and has a ring portion at its lower end surrounding the upper portions of the spring fingers and movable downwardly to cam the fingers inwardly to grasp a loose article in the well. Latching tongues on the spring fingers engage the ring when the fingers are cammed inwardly. In one form the body member is attachable to a drill string and the upper end of the inner member functions as a piston to be pushed downwardly by drilling mud from the drill string. In another form the inner member can be attached to the drill string and held in an upper position relative to the body member by shear pins which are severable by the weight of the drill string.

8 Claims, 11 Drawing Figures

TOOL RETRIEVER FOR WELLS

BACKGROUND OF THE INVENTION

This invention is in the field of devices for retrieving loose articles from wells.

In drilling wells such as deep oil wells or the like, tools or other loose articles sometimes fall to the bottom of the well and drilling cannot continue while those articles remain therein. Occasionally a toothed cone of a rotary drill bit will become detached or broken and impede further drilling, making it necessary to remove the loose piece. Many devices have been proposed for retrieving tools or other loose articles from the bottom of such wells. See, for example, the U.S. Pat. Nos. to Lang 2,709,617, Sutliff 2,505,073, Fitzpatrick 1,775,340, and Steele 3,152,829. The Lang patent provides a tubular body having a piston slidable therein and spring fingers projecting downwardly from the piston along the inner periphery of the tubular body. Camming means at the bottom periphery of the tubular body cause the spring fingers to flex inwardly as the piston is forced down and, hopefully, grip and retain a loose article in the bottom of the well. A loose ball can be dropped through the drill string to close an opening in the piston and serve as a valve to trap drilling mud above the piston to effect downward movement. The spring fingers of this device, however, are flexed a great amount and breakage is likely to occur. Furthermore, as the piston moves downwardly the spring fingers scrape along the bottom of the well and could become engaged with the rock formation, preventing satisfactory operation. The Sutliff and Fitzpatrick devices propose pivoted fingers and a relatively complex mechanism for swinging them inwardly to grasp a loose article in the well but in these devices also the fingers can scrape along the bottom of the well and thus are subject to malfunction. The Steele patent is designed for a special purpose, that is, the removal of a tool having a particular upper formation and relies on the resiliency of spring fingers to close them on the tool.

The devices referred to above are not completely satisfactory when a loose article is to be removed from a well.

SUMMARY OF THE INVENTION

This invention provides a simple structure, easy to operate, employing normally spread-apart spring fingers cammed together by a surrounding ring when the latter is lowered and means are provided to prevent engagement of the spring fingers with the well bottom.

It is, therefore, an object of this invention to provide a relatively inexpensive and reliable device for retrieving loose articles from the bottom of wells.

A further object is to provide such a device having means for initially flushing the well bottom with drilling mud to remove all loose material prior to retrieving the tool or other loose article.

A still further object of the invention is to provide a device as referred to that can be actuated by simple manipulations at the ground surface.

DESCRIPTION OF THE PREFERRED EMBODIMENTS

Figure 1:
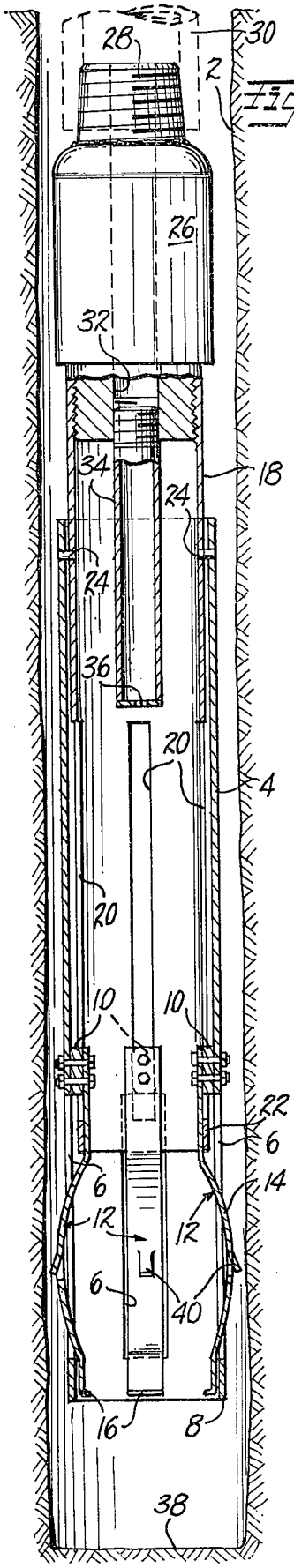
FIG. 1 is a vertical sectional view of one embodiment of the present invention showing the same near but spaced from the bottom of a well.

Referring first to FIGS. 1–4 and 7, the retriever illustrated is adapted to be lowered into a well 2 and comprises an outer tubular body member 4 of generally cylindrical configuration and having longitudinal slots 6 near its lower end but terminating short of the bottom 8 thereof. Thus, the bottom of the tubular body 4 is in the form of a circumferentially continuous annulus. Immediately above each slot 6 is a spacer member 10 secured to the body 4 and to which the upper end of a spring finger 12 is fixedly secured by any suitable means so that the upper end portions of the spring fingers are spaced inwardly from the inner surface of the tubular body member 4. Each of the spring fingers extends downwardly a short distance then outwardly to define a cam surface 14 along at least the upper portion thereof. The spring fingers thus bow outwardly through the slots 6. At their lower ends the spring fingers are directed inwardly within the bottom annulus portion previously referred to and are formed to define inwardly directed lower hooked ends 16. It is to be noted that the hooks 16 are spaced inwardly a slight distance from the lower edge 8 of member 4.

An inner tubular member 18 is longitudinally slidable within the body member 4 and is provided with longitudinal slots 20 slidably embracing the spacers 10. The slots 20 terminate short of the bottom of the inner tubular member 18 and the latter thus defines a circumferentially continuous ring portion 22 surrounding the upper portions of the spring fingers 12, above the cam surfaces 14 thereof. In the relative positions shown in FIG. 1, the tubular members 4 and 18 are held in the described relation by shear pins 24 extending through the walls thereof. The upper end of the inner tubular member 18 projects upwardly through the open upper end of body member 4 and has secured thereto a couple 26 having the usual tapered threaded portion 28 by which it may be attached to a drill string indicated at 30. The coupler 26 is provided with an axial bore 32 through which drilling mud from the drill string 30 may flow. A jet nozzle device 34 is threaded into the bore 32 and is provided with a jet opening 36 at the bottom thereof to direct a jet of drilling mud to the bottom of the well.

Figure 2:
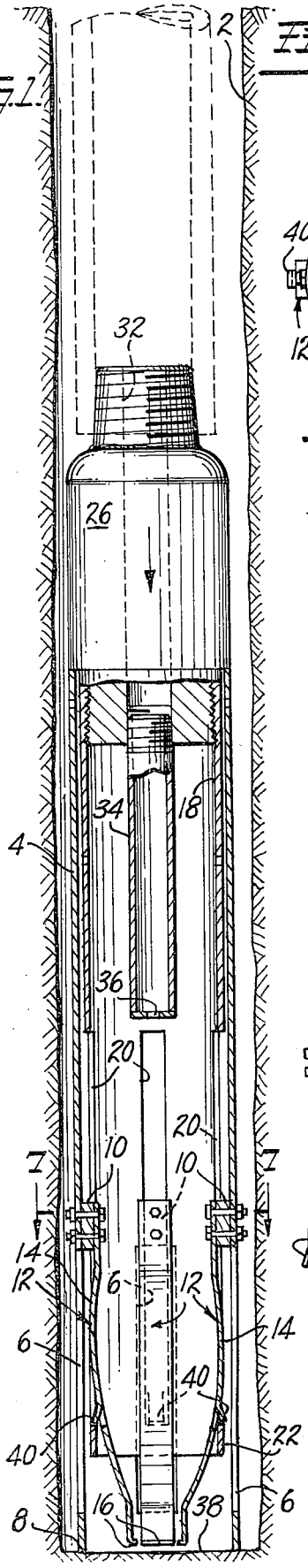
FIG. 2 is a view similar to FIG. 1 but showing the retriever thereof in a closed and lowered position.
Figure 3:
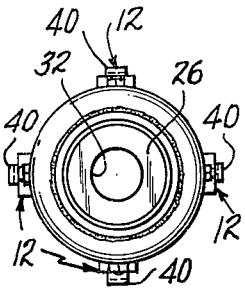
FIG. 3 is a top plan view of the retriever of FIG. 1.
Figure 4:
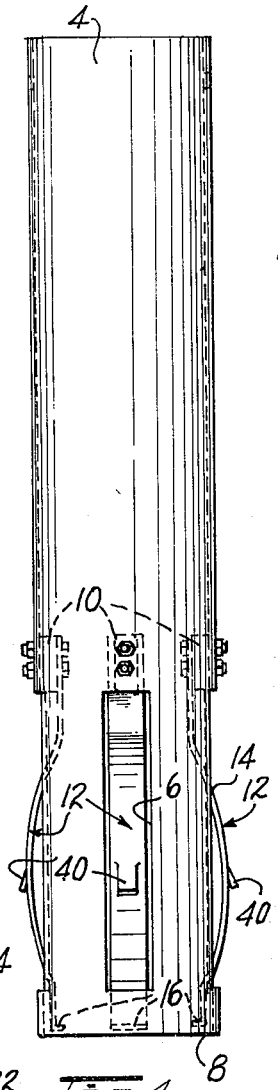
FIG. 4 is a side elevational view of the tubular body member of FIGS. 1 and 2.

In operation, the device is lowered into a well as indicated in FIG. 1 and drilling mud is pumped downwardly under pressure to issue from opening 36 and create a jet stream directed downwardly capable of washing loose material and fine debris from the bottom of the well. The device is then lowered until the bottom edge 8 of body member 4 engages the bottom 38 of the well, as shown in FIG. 2, at which time downward movement of the body member is impeded or arrested. The shear pins 24 previously referred to are of sufficient strength to hold the parts in the position of FIG. 1 as long as the retriever device is not resting on the well bottom. However, when downward movement of the body member is arrested, as in FIG. 2, the weight of the drill string 30 is imposed on the device and is sufficient to rupture or shear the pins 24 permitting that weight to then push the inner tubular member 18 downwardly relative to body member 4. Such downward movement causes the ring 22 to move down over cam surfaces 14 of the spring fingers and thus flex those fingers inwardly, as shown in FIG. 2. The spring fingers are so configured that when the ring 22 reaches the position shown in FIG. 2 the hooks 16 are adjacent each other in position to grip and hold the loose article to be retrieved. Since the fingers 12 are formed of spring material, for example, spring steel, they can resiliently accommodate to loose articles of different size or shape while permitting the ring 22 to move to the position shown in FIG. 2.

Each of the spring fingers 12 is provided with an outwardly struck tongue 40 constituting a latching device. As shown in FIG. 2, the ring 22 moves downwardly over the cam surfaces 14 and then over the tongues 40 at which time the mid portions of the spring fingers snap outwardly a very short distance to engage the bottoms of the tongues 40 with the upper edge of ring 22, in the bottoms of slots 20 of the inner tubular member 18. Thus, the spring fingers are latched in their gripping position and by pulling the drill string 30 upwardly the entire retriever is lifted from the well with the loose article gripped thereby and the upward force on the inner tubular member cannot at that time cause the ring 22 to move upwardly along the spring fingers which would result in releasing the article before it could be lifted from the well. The latch fingers 40 thus constitute a simple means for ensuring withdrawal of the article. It is to be noted that, with the body member 4 resting on the bottom 38 of the well, the spring fingers are free to flex inwardly or outwardly without engaging the well bottom thus ensuring their grasping the loose article to be retrieved.

Figure 5:
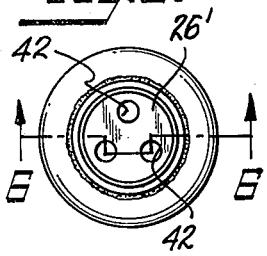
FIG. 5 is a top plan view of a modified form of the retriever of FIG. 1.
Figure 6:
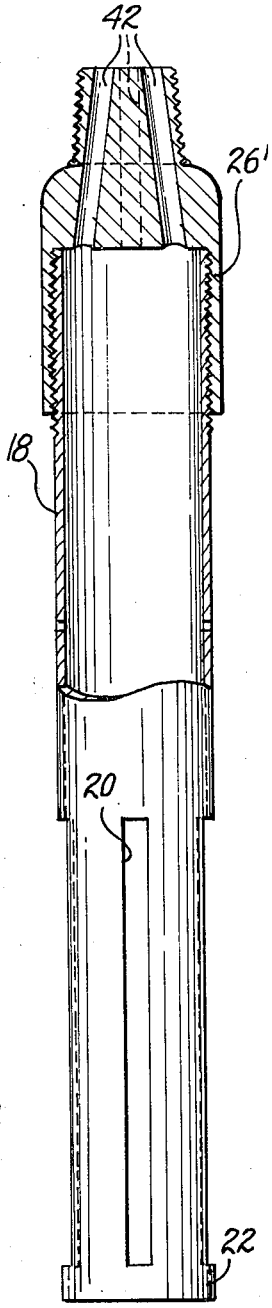
FIG. 6 is an elevational view of the modification of FIG. 5 with parts thereof being shown in section.
Figure 7:
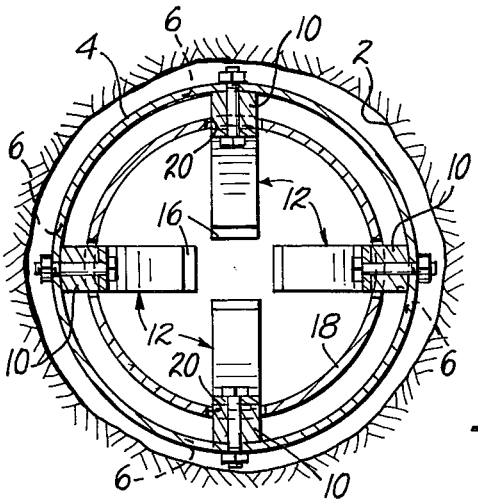
FIG. 7 is an enlarged transverse sectional view taken on the line 7—7 of FIG. 2.
Figure 10:
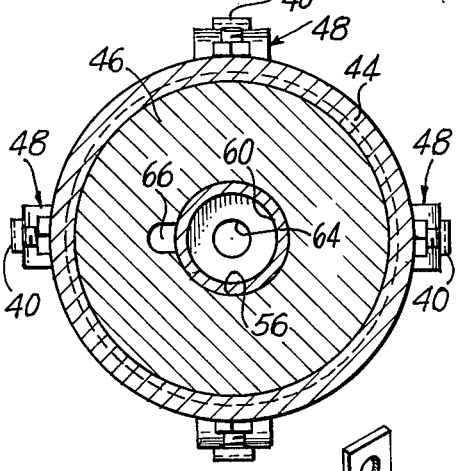
FIG. 10 is a transverse sectional view taken along the line 10—10 of FIG. 8.

FIGS. 5 and 6 illustrate a minor modification of the device heretofore described. In FIGS. 1 and 2, the jet device 34-36 provides for directing a single jet of drilling mud into the well to wash the same. In FIGS. 5 and 6, the tubular device 34 is eliminated and the coupler 26′ is provided with a plurality of jet orifices 42 arranged to receive drilling mud from the drill string and to individually direct jets downwardly within the inner tubular member 18.

Figure 8:
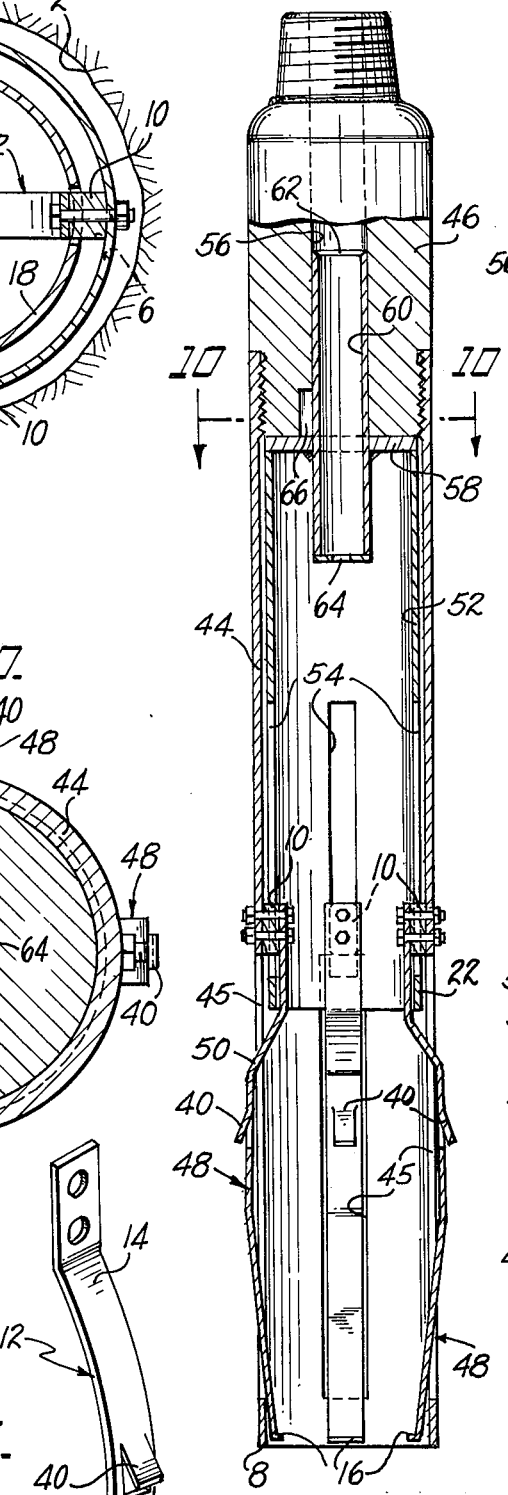
FIG. 8 is a longitudinal sectional view, similar to FIG. 1, of a further embodiment of the invention.
Figure 9:
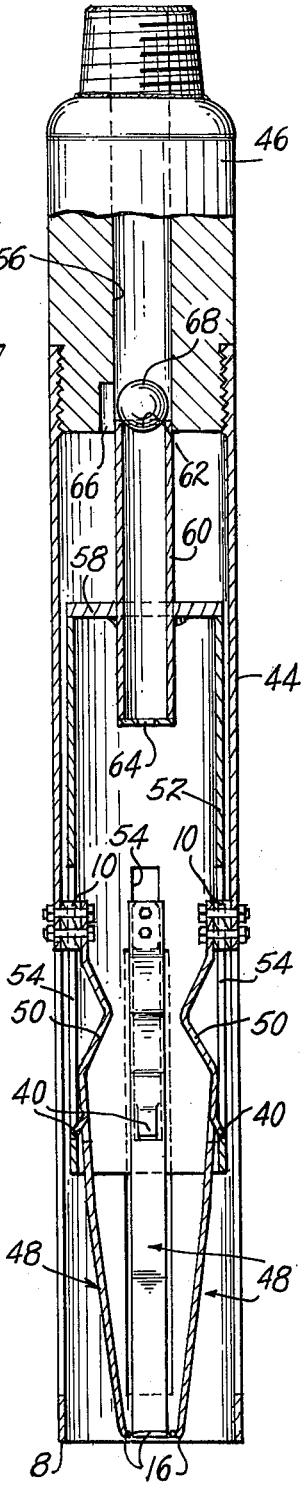
FIG. 9 is a sectional view similar to FIG. 8 but showing parts in different relative positions.
Figure 11:
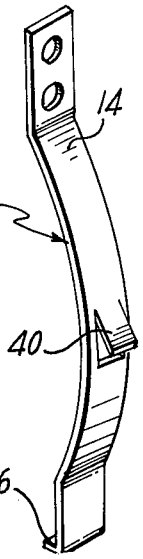
FIG. 11 is a perspective view of one of the spring fingers of the embodiments of FIGS. 1–6.

Referring now to FIGS. 8 and 9, showing a further modification of the invention, the outer tubular body member 44 has a coupler 46 secured to its upper end and by which the retriever is adapted to be attached to a drill string. The body member 44 is provided with slots 45 which may be identical to those described with reference to FIG. 1 and the spacers 10 support the upper ends of spring fingers 48 spaced inwardly from the inner surface of member 44. The spring fingers 48 are provided with upper cam surfaces 50, similar to those of FIG. 1, and latching tongues 40 as already described. An inner tubular member 52 has slots 54 therein identical in all essential respects to the slots 20 previously described with reference to FIGS. 1 and 2 and which terminate short of the bottom of the member 52 to define the ring 22 which may be identical in shape and function to the ring 22 of FIG. 1.

The coupler 46 is provided with an axial bore 56 extending therethrough and the inner tubular member 52 is closed at its upper end by an end wall or closure member 58. A tubular piston 60 extends through the closure 58 and is slidable in the bore 56, with a piston fit therein. The upper end of tubular piston 60 defines a tapered seat 62 and the lower end is provided with an opening 64 through which drilling mud can be directed downwardly to wash the well prior to closing of the spring fingers. A groove or channel 66 is formed near the lower end of bore 56 for a purpose to be described later. It is to be noted that, due to the shape of the spring fingers 48 and cam surfaces 50, the resilience of the spring fingers which holds them in their outer position is sufficient to support the weight of the inner tubular member 52 while the device is being lowered into a well. If desired, however, shear pins similar to those previously described may be employed to hold the parts in the positions shown in FIG. 8., but these shear pins should be such that they can be severed by the drilling mud pressure, to be referred to.

When the retriever has been lowered to the bottom of a well, a ball valve 68 is dropped from the surface through the drill string and becomes seated on the valve seat 62 at the upper end of tubular piston 60. This blocks passage of drilling mud through the piston 60 and the pressure of the drilling mud is then applied to the piston to sever shear pins if such are employed and to force piston 60 and the inner tubular member 52 downwardly to the position shown in FIG. 9 wherein the spring fingers 48 are flexed inwardly to grasp the loose article to be retrieved. When the piston 60 reaches the lower position shown, the ball 68 uncovers a portion of the channel 66 thus relieving the pressure of drilling mud in the drill string. This reduction in pressure can be detected at the surface and constitutes an indication that the spring fingers have been closed upon the article to be retrieved.

It is to be noted that the spring fingers in both forms of the invention are normally biased to their outer position and are held therein by their own resiliency. They are then forcibly flexed inwardly by the ring 22 which becomes latched in its lower position by the latch tongues 40.

While a limited number of specific embodiments of the invention have been shown and described, the same are merely illustrative of the principles involved and other forms may be resorted to within the scope of the accompanying claims.

We claim:

1. A retriever for loose articles in wells, comprising:

a generally tubular body member adapted to be lowered into a well;

a plurality of circumferentially spaced downwardly extending resilient fingers fixed at their upper ends to a lower portion of said body member, said resilient fingers being normally spaced apart to receive a loose article therebetween and each having an inturned lower end defining a hook portion, said fingers being configured to define downwardly and outwardly sloping cam surfaces along at least the upper portions thereof;

a ring member surrounding the upper portions of said fingers and being movable downwardly along said cam surfaces to thereby flex said fingers inwardly to move said hook portions toward each other and thereby grasp a loose article in said well;

actuator means for moving said ring member downwardly relative to said tubular body member; and interengageable latching means on said ring and on said fingers adjacent the lower ends of said cam surfaces to latch said ring against upward movement relative to said fingers after said ring has been moved downwardly over said cam surfaces and thereby prevent release of a loose article held by said hook portions and comprising protuberances on said fingers, each having a downwardly facing surface engageable with an upwardly facing surface of said ring member.

2. A retriever as defined in claim 1 wherein said actuator means comprises an inner tubular member slidable longitudinally within said tubular body member and drivingly connected to said ring member.

3. A retriever as defined in claim 2 wherein said resilient fingers are fixed, at their upper ends, to spacers secured to the inner surface of said body member, said tubular inner tubular member having longitudinal slots therein through which said spacers extend, the lower end portion of said inner tubular member being peripherally continuous and constituting said ring member.

4. A retriever as defined in claim 2 including means for connecting the upper end of said retriever to a drill string and means therein for directing at least one jet of drilling mud from said drill string to the interior of said inner tubular member downwardly into said well.

5. A retriever as defined in claim 2 wherein said inner tubular member extends upwardly beyond said tubular body member and is provided with means at its upper end for connecting it to a drill string, at least one shear pin holding said inner tubular member against movement relative to said tubular body member and serving to hold said ring member around the upper portions of said fingers, whereby when said retriever reaches the bottom of a well and downward movement of said body member is impeded, the weight of said drill string shears said shear pin and moves said inner tubular member downwardly and said ring member downwardly over said cam surfaces.

6. A retriever as defined in claim 2 wherein said tubular body member is provided with a coupler at its upper end for securing said retriever to a drill string, said coupler having an axial bore therethrough;

said inner tubular member having an upwardly directed tubular extension slidable in said axial bore with a piston fit therein to direct a stream of drilling mud downwardly from said drill string through said retriever; and a valve ball of a size to fall through said drill string and into said bore into closing relation to the upper end of said tubular extension whereupon said tubular extension and valve ball function as a piston responsive to the pressure of drilling mud in said drill string to force said inner tubular member downwardly in said tubular body and flex said fingers inwardly.

7. A retriever as defined in claim 6 wherein said axial bore is provided with a bypass channel adjacent the lower end thereof to relieve drilling mud pressure in said drill string as an indication that said spring fingers have been flexed inwardly.

8. A retriever as defined in claim 1 wherein at least a portion of said tubular body member extends downwardly below the ends of said fingers whereby when said portion of said tubular body member engages the bottom of a well the hook portions of said fingers are somewhat spaced above said bottom.

* * * * *